US006151039A

United States Patent [19]

Hmelar et al.

[11] Patent Number: 6,151,039

[45] Date of Patent: Nov. 21, 2000

[54] INK LEVEL ESTIMATION USING DROP COUNT AND INK LEVEL SENSE

[75] Inventors: Susan M. Hmelar, Corvallis, Oreg.; Michael L. Bullock, San Diego, Calif.; Norman E. Pawlowski, Jr., Corvallis, Oreg.

[73] Assignee: Hewlett-Packard Company, Palo Alto, Calif.

[21] Appl. No.: 08/869,122

[22] Filed: Jun. 4, 1997

[51] Int. Cl.[7] ..... B41J 2/175

[52] U.S. Cl. ..... 347/7

[58] Field of Search ..... 347/7, 23, 19; 399/27; 73/290 R, 304 R

[56] References Cited

U.S. PATENT DOCUMENTS

| | | | |
|---|---|---|---|
| 4,354,382 | 10/1982 | Hagglund | 73/290 R |
| 4,415,886 | 11/1983 | Kyoguku et al. | 340/618 |
| 4,568,954 | 2/1986 | Rosback | 347/86 |
| 5,051,921 | 9/1991 | Paglione | 364/509 |
| 5,365,312 | 11/1994 | Ruediger et al. | 399/12 |
| 5,631,674 | 5/1997 | Shinada et al. | 347/7 |
| 5,694,156 | 12/1997 | Hoisington et al. | 347/7 |
| 5,712,667 | 1/1998 | Sato | 347/7 |

FOREIGN PATENT DOCUMENTS

| | | |
|---|---|---|
| 0593282 | 4/1991 | European Pat. Off. . |
| 0626268 | 11/1994 | European Pat. Off. . |
| 0720916 | 7/1996 | European Pat. Off. . |
| 2312283 | 10/1997 | United Kingdom . |

OTHER PUBLICATIONS

European Search Report for Application Number EP 98 10 3480, Feb. 10, 2000.

*Primary Examiner*—John Barlow
*Assistant Examiner*—Craig A. Hallacher
*Attorney, Agent, or Firm*—Manuel Quiogue

[57] ABSTRACT

A printing system including an ink container having a memory and an ink level sensing circuit, a print cartridge having a memory, and a printer controller. Remaining ink level in the ink container is estimated pursuant to ink drop usage information provided by the ink container memory and ink level sense information provided by the ink level sensing circuit.

46 Claims, 13 Drawing Sheets

CONT. FIG. 6
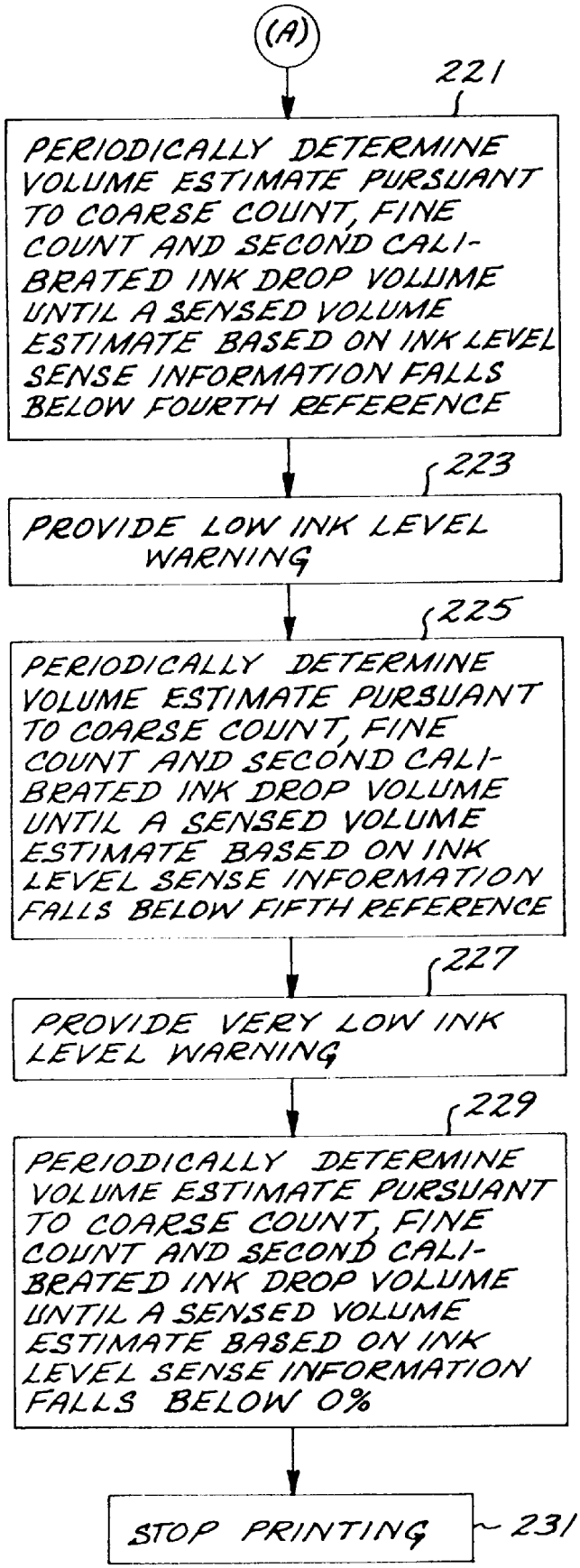

INK LEVEL ESTIMATION USING DROP COUNT AND INK LEVEL SENSE

This application is related to commonly assigned co-pending U.S. Ser. No. 08/633,613, filed Apr. 17, 1996, docket number 10951138, entitled "Inductive Ink Level Detection Mechanism For Ink Supplies", incorporated herein by reference; commonly assigned co-pending U.S. Ser. No. 08/869,038, docket number 10970423, filed herewith, entitled "Electrical Interconnect for Replaceable Ink Containers", incorporated herein by reference; commonly assigned co-pending U.S. Ser. No. 08/869,150, docket number 10970424, filed herewith, entitled "Method and Apparatus for Securing an Ink Container", incorporated herein by reference; commonly assigned co-pending U.S. Ser. No. 08/871,566, docket 10970426, filed herewith, entitled "Replaceable Ink Container Adapted To Form Reliable Fluid, Air And Electrical Connection To A Printing System", incorporated herein by reference; commonly assigned co-pending U.S. Ser. No. 08/869,240, docket number 10970427, filed herewith, entitled "Ink Container With An Inductive Ink Level Sense", incorporated herein by reference; commonly assigned co-pending U.S. Ser. No. 08/868,773, docket number 10970429, filed herewith, entitled "Ink Container Providing Pressurized Ink With Ink Level Sensor", incorporated herein by reference; commonly assigned co-pending U.S. Ser. No. 08/868,927, docket number 10970430, filed herewith, entitled "An Ink Container Having A Multiple Function Chassis", incorporated herein by reference; commonly assigned co-pending U.S. Ser. No. 08/869,023, docket number 10970431, filed herewith, entitled "High Performance Ink Container with Efficient Construction", incorporated herein by reference; and commonly assigned co-pending U.S. Ser. No. 08/785,580, docket number 10960726, filed Jan. 21, 1997, entitled "Apparatus Controlled by Data from Consumable Parts with Incorporated Memory Devices", incorporated herein by reference.

BACKGROUND OF THE INVENTION

The disclosed invention relates to ink jet printing systems that employ replaceable consumable parts including ink cartridges, and more particularly to mechanisms for estimating the amount of ink remaining in an ink cartridge.

The art of ink jet printing is relatively well developed. Commercial products such as computer printers, graphics plotters, and facsimile machines have been implemented with ink jet technology for producing printed media. Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Some known printers make use of an ink container that is separably replaceable from the printhead. When the ink container is exhausted it is removed and replaced with a new ink container. The use of replaceable ink containers that are separate from the printhead allow users to replace the ink container without replacing the printhead. The printhead is then replaced at or near the end of printhead life, and not when the ink container is replaced.

A consideration with ink jet printing systems that employ ink containers that are separate from the printheads is the general inability to predict an out of ink condition for an ink container. In such ink jet printing systems, it is important that printing cease when an ink container is nearly empty, with a small amount of stranded ink. Otherwise, printhead damage may occur as a result of firing without ink, and/or time is wasted in operating a printer without achieving a complete printed image, which is particularly time consuming in the printing of large images which often are printed in an unattended manner on expensive media.

A known approach to estimating remaining ink volume involves immersing electrodes in an ink volume and measuring a resistance path through the ink. Considerations with this approach include the complexity of incorporating electrodes in an ink container, and the variation of electrical properties with ink formulation.

SUMMARY OF THE INVENTION

One aspect of the invention is directed to an ink container that includes an ink reservoir, a memory device for providing an ink drop count based available volume of ink, and an ink level sensing circuit for providing an ink level sense output that is indicative of a sensed volume of ink.

Another aspect of the invention is directed to a method that estimates remaining ink volume pursuant to drop counting based on (1) a nominal ink drop volume when the estimated remaining ink volume is greater than a selected level, and (2) a calibrated and then recalibrated ink drop volume when the estimated remaining ink volume is reduced, wherein the recalibrated drop volume is based on a sensed ink volume.

A further aspect of the invention is directed to estimating remaining ink volume pursuant to ink drop counting over a first estimated ink volume range and ink volume sensing over a second estimated ink volume range.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
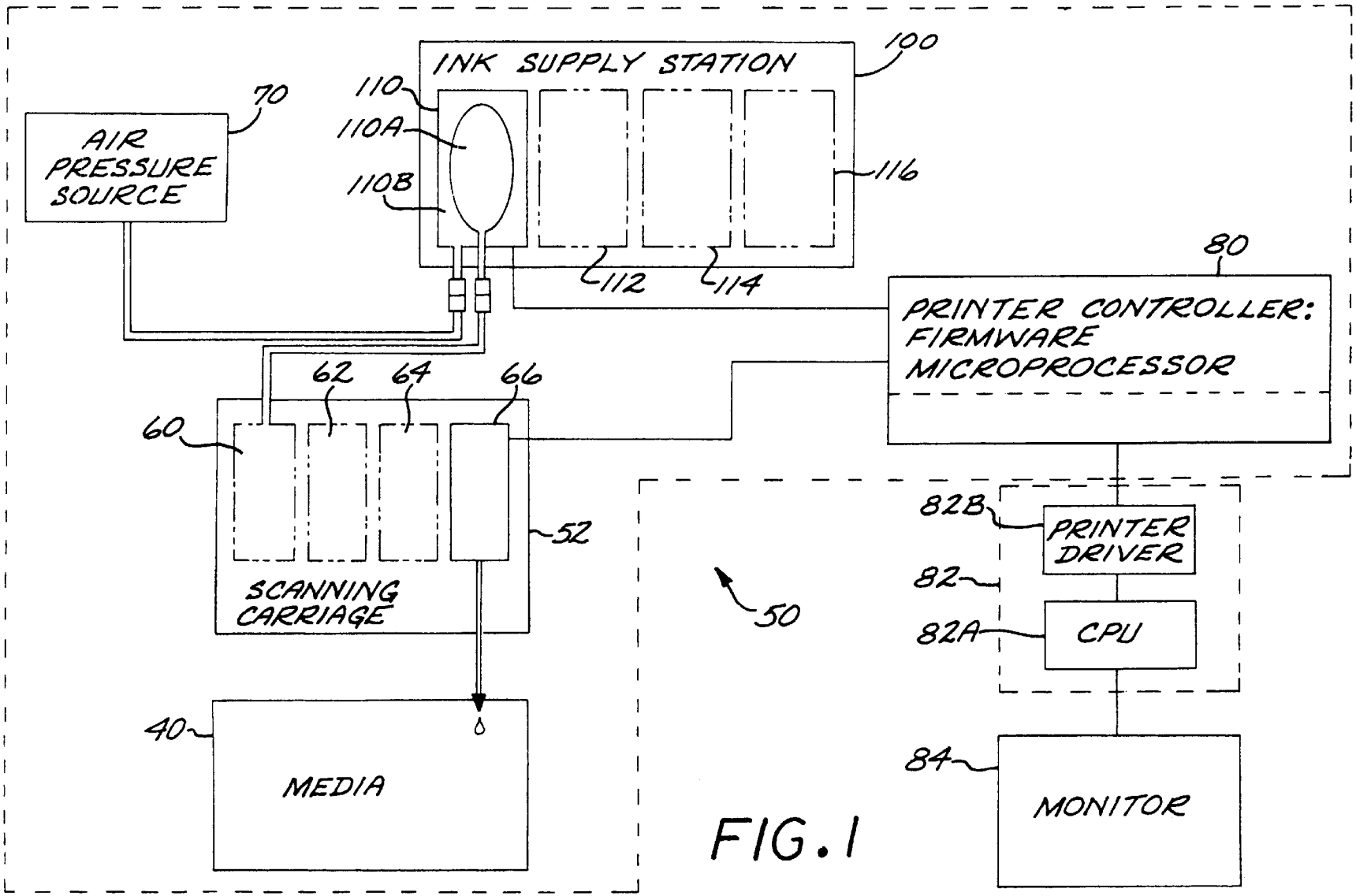
FIG. 1 is a schematic block diagram of an printer/plotter system in which the invention can be incorporated.

In the following detailed description and in the several figures of the drawing, like elements are identified with like reference numerals.

Referring now to FIG. 1, set forth therein is a schematic block diagram of a printer/plotter 50 in which the invention can be employed. The invention generally contemplates estimating remaining ink volume in an ink container pursuant to ink drop counting and ink level sensing in a manner that optimizes the accuracy of the estimate.

Figure 2:
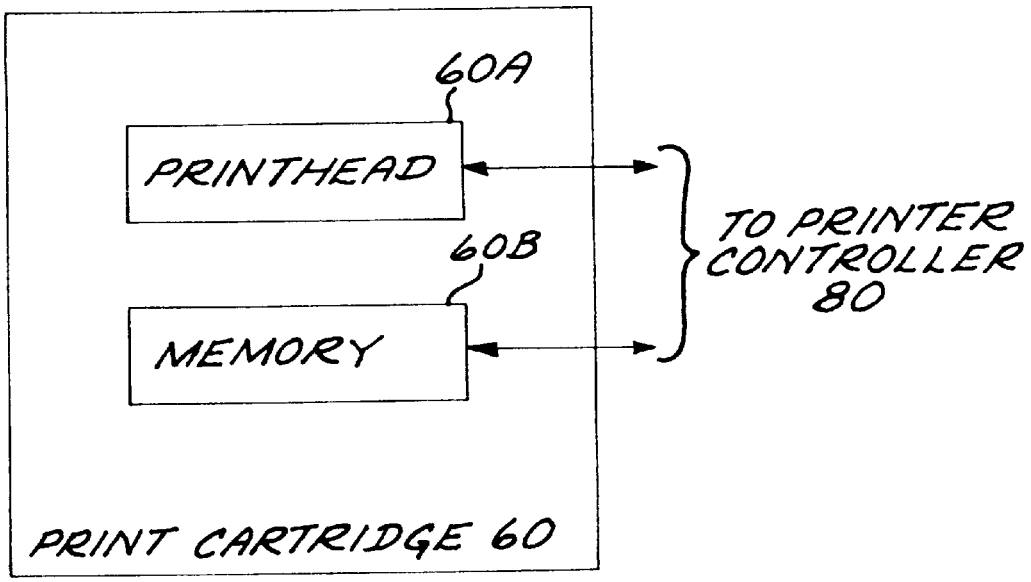
FIG. 2 is a schematic block diagram depicting major components of one of the ink containers of the printer/plotter system of FIG. 1.

A scanning print carriage 52 holds a plurality of print cartridges 60–66 which are fluidically coupled to an ink supply station 100 that supplies pressurized ink to the print cartridges 60–66. By way of illustrative example, each of the cartridges 60–66 comprises an ink jet printhead and an integral printhead memory, as schematically depicted in FIG. 2 for the representative example of the print cartridge 60 which includes an ink jet printhead 60A and an integral printhead memory 60B. Each print cartridge has a fluidic regulator valve that opens and closes to maintain a slight negative gauge pressure in the cartridge that is optimal for printhead performance. The ink provided to each of the cartridges 60–66 is pressurized to reduce the effects of dynamic pressure drops.

The ink supply station 100 contains receptacles or bays for accepting ink containers 110–116 which are respectively associated with and fluidically connected to respective print cartridges 60–66. Each of the ink containers 110–116 includes a collapsible ink reservoir, such as collapsible ink reservoir 110A that is surrounded by an air pressure chamber 110B. An air pressure source or pump 70 is in communication with the air pressure chamber for pressurizing the collapsible ink reservoir. For example, one pressure pump supplies pressurized air for all ink containers in the system. Pressurized ink is delivered to the print cartridges by an ink flow path that includes for example respective flexible plastic tubes connected between the ink containers 110–116 and respectively associated print cartridges 60–66.

Figure 3:
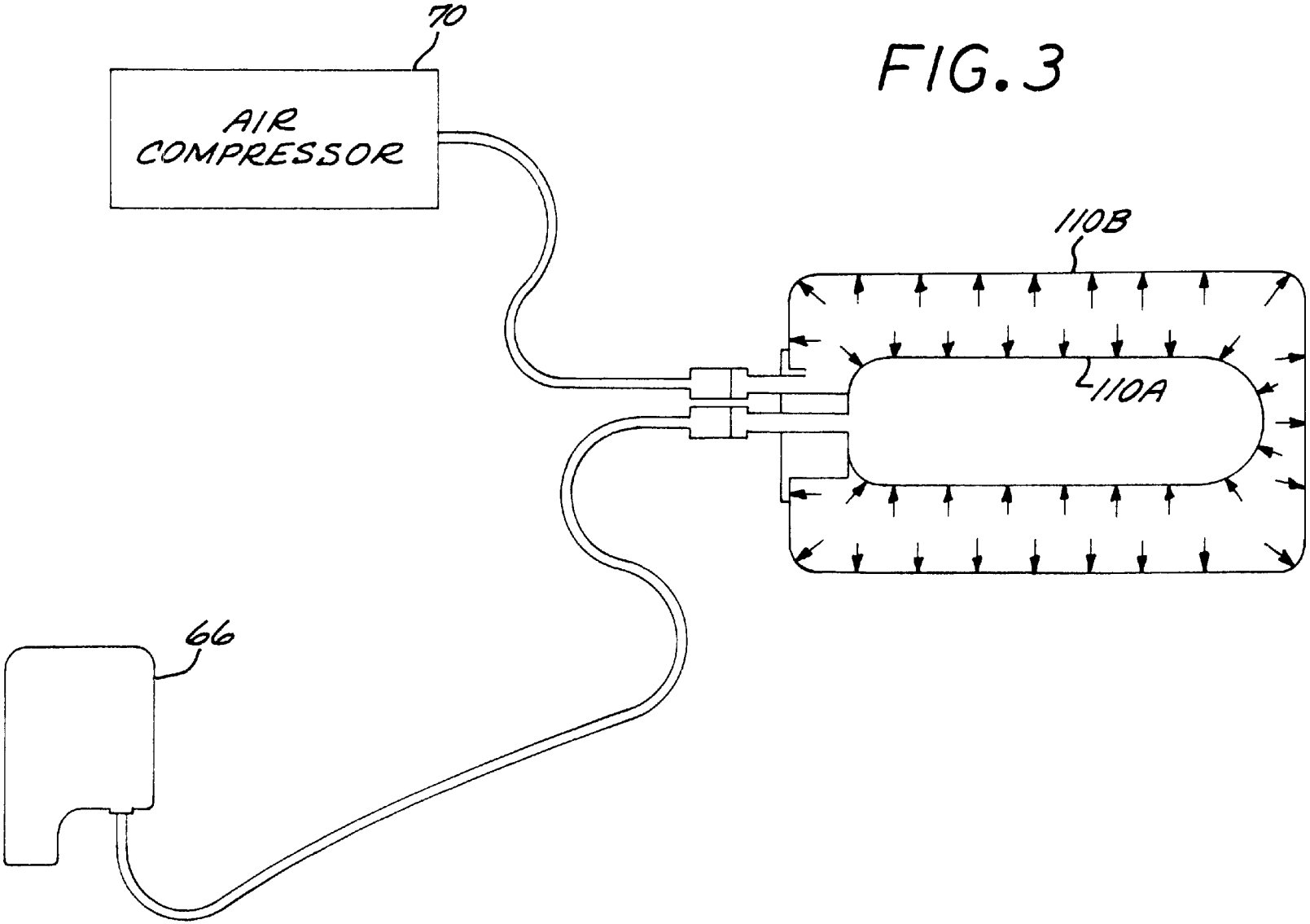
FIG. 3 is a schematic block diagram illustrating in a simplified manner the connection between an off-carriage ink container, an air pressure source, and an on-carriage print cartridge of the printer/plotter system of FIG. 1.

FIG. 3 is a simplified diagrammatic view illustrating the pressure source 70, the print cartridge 66, and the collapsible ink reservoir 110*a* and pressure chamber 110B. During idle periods, the pressure chamber 110B (which is defined by a pressure vessel, as more particularly described herein) is allowed to de-pressurize. Also, the ink containers 110–116 are not pressurized during shipment.

Figure 4:
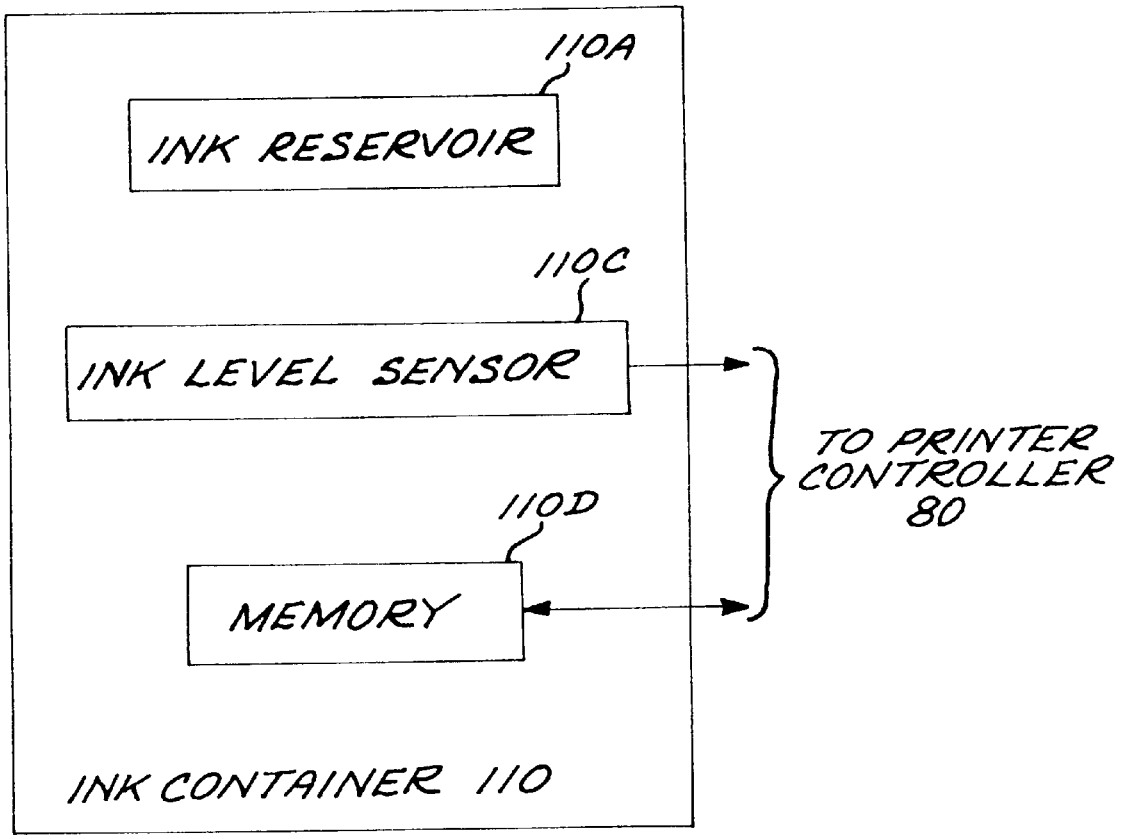
FIG. 4 is a schematic block diagram depicting major components of one of the print cartridges of the printer/plotter system of FIG. 1.

By way of illustrative example, each of the ink containers 110–116 comprises an ink reservoir, an ink level sensing circuit, and an integral ink cartridge memory, as schematically depicted in FIG. 4 for the representative example of the ink container 110 which more particularly includes the ink reservoir 11A, an ink level sensing circuit 110C, and an integral ink cartridge memory 110D.

Continuing to refer to FIG. 1, the scanning print carriage 52, the print cartridges 60–66, and the ink containers 110–114 are electrically interconnected to a printer microprocessor controller 80 that includes printer electronics and firmware for the control of various printer functions, including analog-to-digital converter circuitry for converting the outputs of the ink level sensing circuits of the ink containers 110–116. The controller 80 thus controls the scan carriage drive system and the printheads on the print carriage to selectively energize the printheads, to cause ink droplets to be ejected in a controlled fashion on the print medium 40. The printer controller 80 further continually estimates remaining ink volume in each of the ink containers 110–114, as described more fully herein.

A host processor 82, which includes a CPU 82A and a software printer driver 82B, is connected to the printer controller 82. For example, the host processor 82 comprises a personal computer that is external to the printer 50. A monitor 84 is connected to the host processor 82 and is used to display various messages that are indicative of the state of the ink jet printer. Alternatively, the printer can be configured for stand-alone or networked operation wherein messages are displayed on a front panel of the printer.

Figure 5:
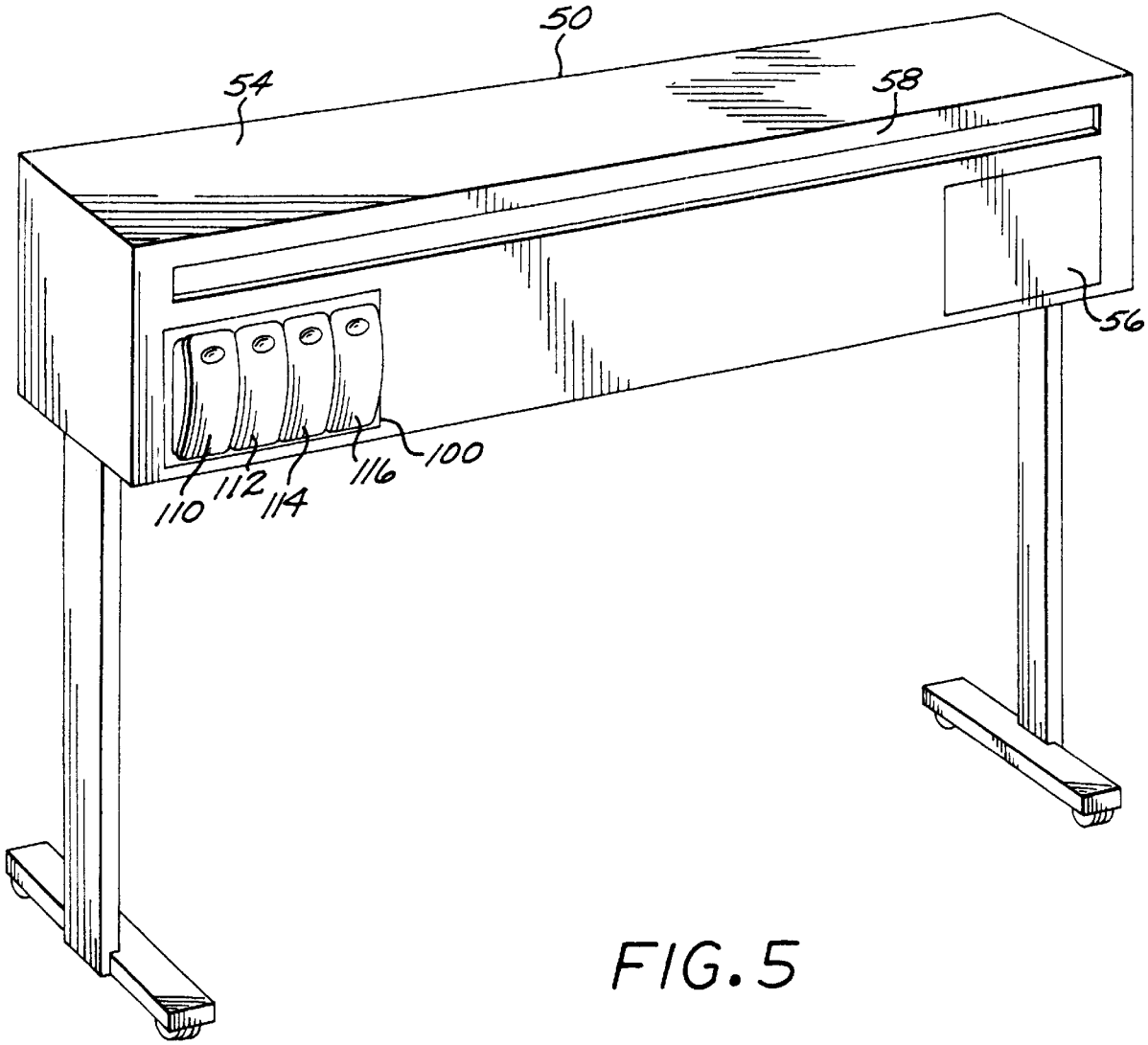
FIG. 5 a simplified isometric view of an implementation of the printer/plotter system of FIG. 1.

FIG. 5 shows in isometric view an exemplary form of a large format printer/plotter in which the invention can be employed, wherein four off-carriage ink containers 110, 112, 114, 116 are show in place in an ink supply station. The printer/plotter of FIG. 5 further includes a housing 54, a front control panel 56 which provides user control switches, and a media output slot 58. While this exemplary printer/plotter is fed from a media roll, it should be appreciated that alternative sheet feed mechanisms can also be used.

In accordance with the invention, the print cartridge memories including print cartridge memory 60B, the ink container memories including ink container memory 110C, and the ink level sensing circuits including ink level sensing circuit 110D enable the controller 82 to determine estimates of the amounts of ink contained in the ink containers 110–116. To accomplish this, each of the printhead memories and the ink container memories includes both factory written data and printer-recorded data.

For purposes of the invention, each of the ink container memories stores factory written ink supply volume data (i.e., factory fill volume) and printer recorded ink drop coarse count and fine count data, while each of the print cartridge memories stores factory written nominal ink drop volume data.

By way of particular example, the fine count data comprises an 8-bit word, with each bit corresponding to $1/256$ of 12.5% of the total supply volume of the corresponding ink container. The coarse count data comprises an 8-bit write-once word wherein bits are progressively written each time the fine count data overflows or "rolls over", such that a coarse count bit is written each time ink drop usage tracking indicates 12.5% of the ink in the ink cartridge is consumed. Thus, the number of written bits in the coarse count data indicates the number of times the fine count data has overflowed. The print cartridge nominal drop volume parameter and the ink container supply volume are read to calculate the number N of ink drops required to cause one fine count bit to toggle (i.e., an amount equal to 1/256 of 12.5% of the total supply volume), and ink usage is tracked by counting ink drops (for example by counting ink firing signals supplied to a printhead) and incrementing the fine count data each time the ink drop count reaches N, wherein the ink drop count is re-started after reaching N. In other words, the fine count data is incremented after every firing of N drops, wherein N is the number of ink drops required to cause one fine count bit to toggle. Since the number of written or set coarse count data bits increases by one each time the fine count data overflows, the coarse count data and the fine count data for a particular cartridge are indicative of the percentage amount of ink used. An estimate of remaining ink volume is calculated from the coarse count data, fine count data, nominal drop volume, and ink supply size data.

Figure 6:
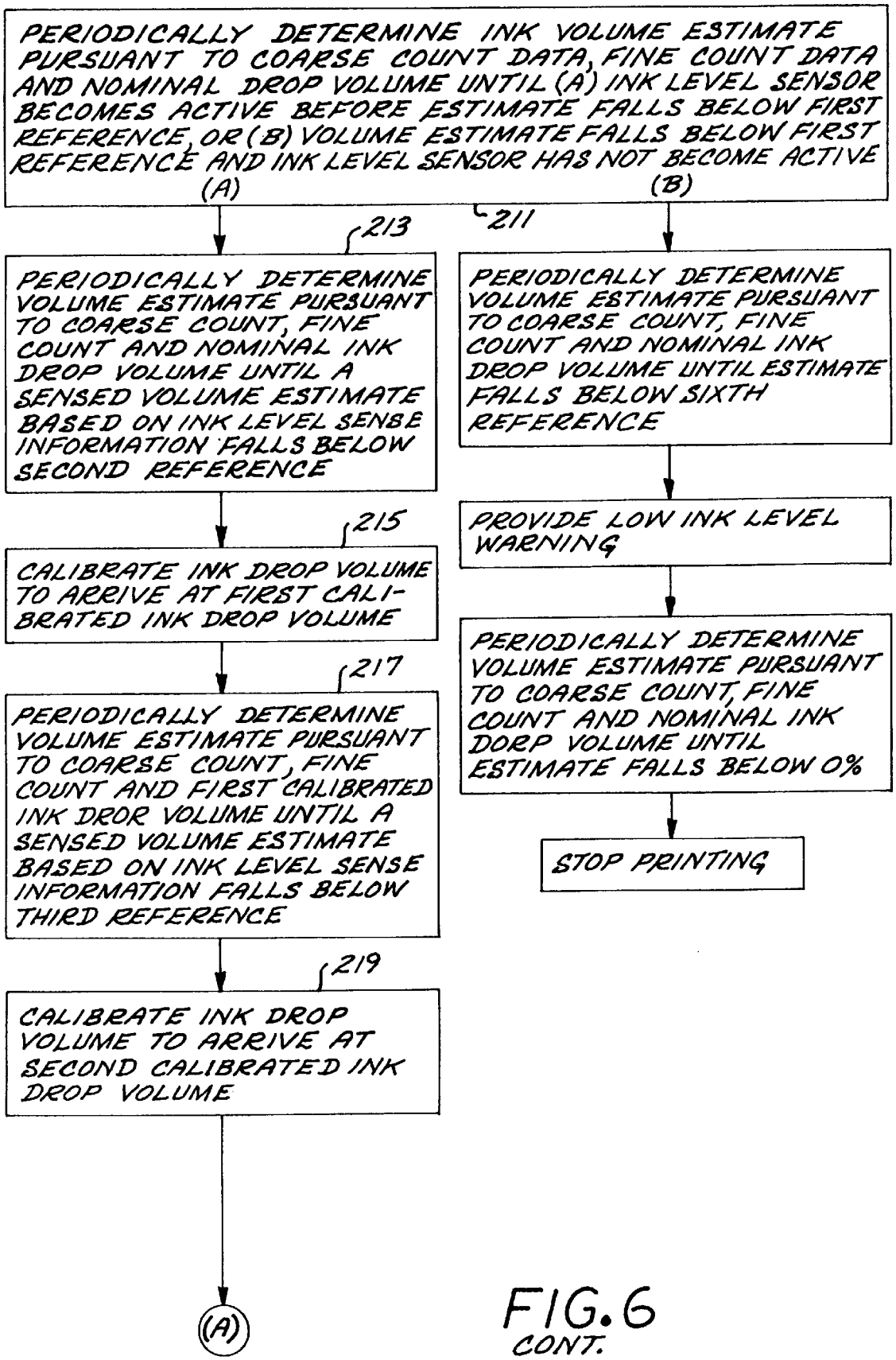
FIG. 6 is a flow diagram of an example of an ink volume estimating procedure in accordance with the invention.

Referring now to FIG. 6, set forth therein is a flow diagram of a procedure for estimating remaining ink volume in accordance with the invention that would be separately implemented for each of the ink containers 110–114 and which optimally uses ink drop count information and ink level sense information to provide more accurate ink level estimation. The estimated remaining ink volume can be used to control an ink "gas gauge" that is displayed for the user for example via the monitor 84 (FIG. 1) or the printer front panel 56 (FIG. 5).

At 211 a remaining ink volume estimate for an ink container is periodically determined pursuant to the coarse count data, the fine count data, and a nominal drop volume until (A) the ink level sensing circuit for the ink container becomes active before the ink volume estimate falls below a first predetermined reference volume, or (B) the ink volume estimate falls below the first predetermined reference volume and the ink level sensing circuit has not become active, where such first predetermined reference volume is selected such that the ink level sensing circuit, if properly operating, will become active before the ink drop based ink volume estimate reaches such first predetermined reference volume. By way of illustrative example, the first predetermined reference volume can be 23% of available ink volume, wherein available ink volume refers to the ink that is available for consumption while stranding a small amount of ink for even the worst case tolerances of determining remaining ink volume.

If the ink level sensing circuit has become active before the remaining ink volume estimate falls below the first predetermined reference volume, at 213 a remaining ink volume estimate is periodically determined pursuant to coarse count, fine count, and nominal ink drop volume until a sensed volume estimate based on the ink level sense information falls below a second reference volume (e.g., 40% of available ink) that is selected to insure that the ink level sensing circuit provides an accurate indication of the volume of the remaining ink.

At 215 ink drop volume is calibrated to arrive at a first calibrated ink drop volume, and at 217 a remaining ink volume is periodically determined pursuant to coarse count, fine count, and the first calibrated ink drop volume until a sensed volume estimate based on ink level sense information falls below a third reference volume (e.g., 33% of available ink) that is selected to insure that the ink level sensing circuit provides an accurate indication of the remaining ink volume.

At 219 the ink drop volume is again calibrated to arrive at a second calibrated ink drop volume, and at 221 a remaining ink volume estimate is periodically determined pursuant to coarse count, fine count, and the second calibrated ink drop volume until the ink drop based remaining ink volume estimate falls below a fourth predetermined reference volume (e.g., 14% of available ink). At 223 a low ink level warning is provided to the user, and at 225 a remaining ink volume estimate is periodically determined pursuant to coarse count, fine count, and the second calibrated ink drop volume until the ink drop based remaining ink volume estimate falls below a fifth predetermined reference volume. At 227 a very low ink level warning is provided to the user, and at 229 a remaining ink volume estimate is periodically determined pursuant to coarse count, fine count, and the second calibrated ink drop volume until the ink drop based remaining ink volume estimate falls below 0% available ink. At 231 printing stops, stranding a small amount of ink.

In the foregoing steps at 213 and 217, remaining ink level is estimated pursuant to drop count information and a first calibrated ink drop volume (in 213) and then a second calibrated ink drop volume (in 217), wherein the calibrated ink drop volumes are determined from remaining ink levels that are sensed or inferred from the ink level sense information provided the ink level sensing circuit. Drop volume is calibrated two times so as to utilize the most accurate ink level sense information. Alternatively, a single calibrated drop volume can be utilized for remaining ink estimation over the estimation range covered by the steps at 213 and 217. As a further alternative, the first and second calibrated values can be compared with each other and if the difference between the two is greater than a predetermined value, a decision can be made to ignore one of the calibrated values, which may require adjustment of the estimation if the first calibrated value needs to be ignored.

Referring again to 215, if the ink volume estimate falls below the first predetermined reference volume and the ink level sensing circuit has not become active, which indicates an inoperative ink level sensing circuit, at 241 a remaining ink volume estimate is periodically determined pursuant to coarse count, fine count, and nominal drop volume until the remaining ink volume estimate falls below a sixth reference volume which is less than the first reference volume (e.g., 6% of available ink). At 243 a user warning of low ink level is issued, and at 245 a remaining ink volume estimate is periodically determined pursuant to coarse count, fine count, and nominal drop volume until the remaining ink volume estimate falls below 0% of available ink. At 247 printing stops. As described earlier, the calculation of remaining ink volume estimates is made in such a manner that insures some small amount of ink will be stranded when the estimate reaches 0% remaining ink volume, so as to avoid potentially damaging dry printing.

Broadly, the foregoing procedure estimates remaining ink volume pursuant to drop counting based on (1) a nominal ink drop volume when the estimated remaining ink volume is greater than a selected level, and (2) a calibrated and then recalibrated ink drop volume when the remaining ink volume is low. Calibration and recalibration are based on the output of the ink level sensing circuit which is configured so as to be very accurate over a predetermined actual ink remaining volume that is selected to be close to the depleted state. In this manner, ink drop volume is accurately calibrated as the remaining volume approaches the depleted state, and the accuracy of the estimate of remaining ink volume is advantageously increased as actual remaining ink volume approaches the desired amount to be stranded.

By way of illustrative example, a calibrated ink drop volume is arrived at by determining an average ink drop volume from a reading of the ink level sensing circuit output, and the corresponding coarse count data and the fine count data. Alternatively, ink drop volume is calibrated pursuant to the difference between the ink drop data (coarse count and fine count) for two readings of the ink level sensing circuit output. The nominal ink drop volume can also be utilized in arriving at a calibrated drop volume, for example by averaging the calculated drop volume and the nominal drop volume.

Figure 7:
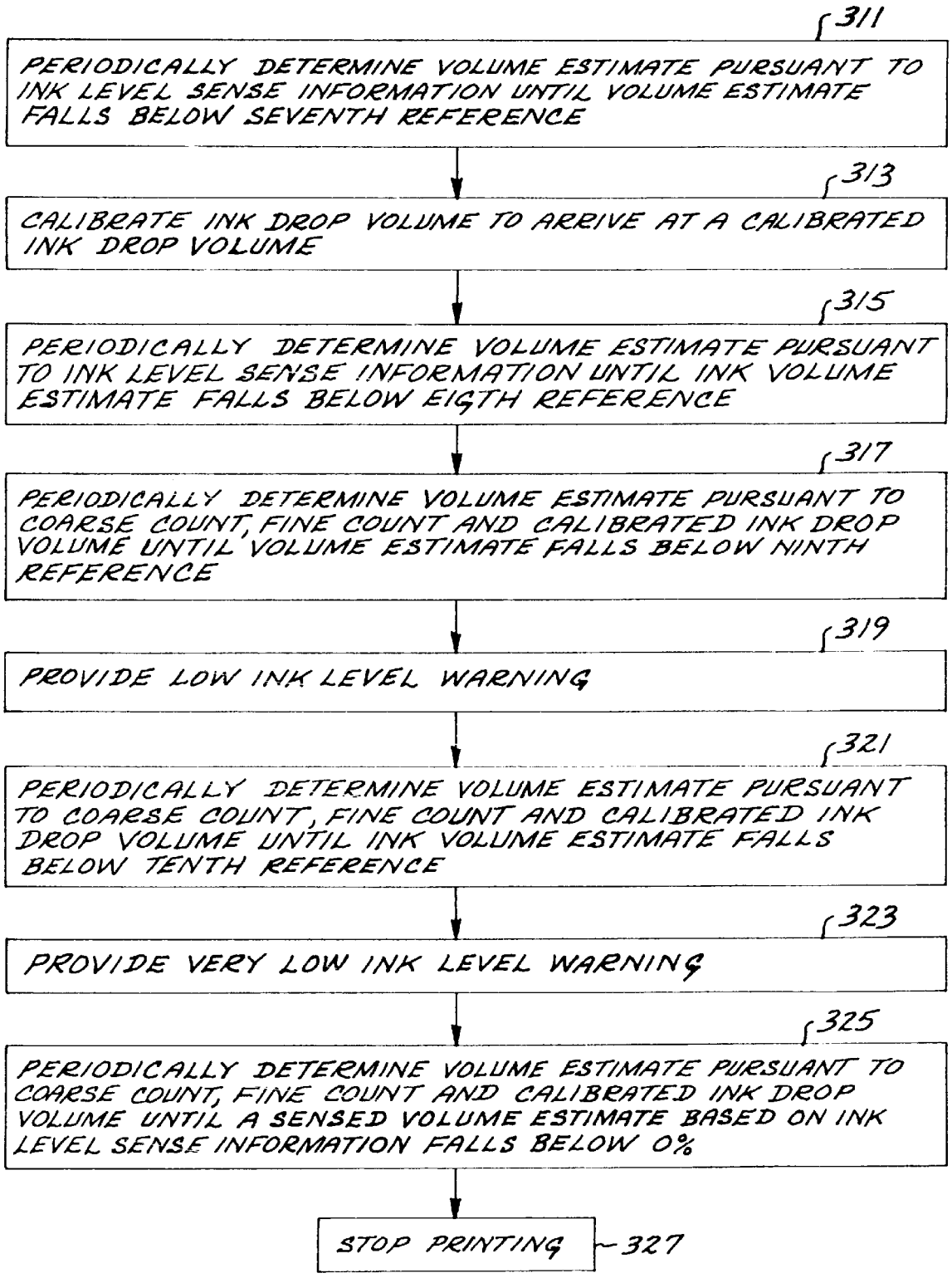
FIG. 7 is a flow diagram of an example of a sub-procedure that can be employed in an ink volume estimating procedure in accordance with the invention.

Referring now to FIG. 7, set forth therein is a flow diagram of an alternative sub-procedure in accordance with the invention for estimating remaining ink volume in an ink container after a determination at 215 that the ink level sensing circuit of the ink container has become active before the ink volume estimate falls below the first predetermined ink drop reference level.

At 311 a remaining ink volume estimate is periodically determined pursuant to the ink level sense information provided by the ink level sensing circuit until the remaining ink volume estimate falls below a seventh reference volume. At 313 ink drop volume is calibrated, and at 315 a remaining ink volume estimate is periodically determined pursuant to the ink level sense information provided by the ink level sensing circuit until the remaining ink volume estimate falls below an eighth predetermined reference volume. At 317 a remaining ink volume estimate is periodically determined pursuant to coarse count, fine count, and the calibrated ink drop volume until the ink drop based remaining ink level decreases to less than or equal to a ninth predetermined reference volume. By way of illustrative example, remaining ink volume is estimated at 317 by reference to absolute ink volume as sensed by the ink level sensing circuit at the time ink volume estimation by ink drop count resumes, for example wherein ink drop based remaining ink volume estimation is referenced to a reference coarse count and fine count that correspond to the remaining ink volume as sensed by the ink level sensing circuit at the time remaining ink level estimation by ink drop count resumes. At 319 a low ink level warning is provided to the user, and at 321 remaining ink volume is determined pursuant to coarse count, fine count, and the calibrated ink drop volume until the remaining ink volume estimate falls below a tenth predetermined reference volume. At 323 a very low ink level warning is provided to the user, and at 325 a remaining ink volume estimate is periodically determined pursuant to coarse count, fine count, and the second calibrated ink drop volume until the ink drop calculated ink drop volume falls to or below 0% available ink. At 327 printing stops, stranding a small amount of ink.

In the foregoing sub-procedure of FIG. 7, remaining ink volume of an ink cartridge is estimated pursuant the output of the ink level sensing circuit of the ink cartridge while the estimated remaining ink volume, as sensed by the level sensing circuit, is in the range over which the ink level sensing circuit is reasonably accurate. Then, as the actual remaining ink volume approaches the depleted state, remaining ink volume is estimated on the basis of coarse count, fine count and an ink level sensing circuit calibrated ink drop volume. In this manner, the ink level sensing circuit is utilized while it is accurate, and the resumed ink drop based remaining ink volume estimation is more accurate as a result of ink drop volume calibration as well as being referenced to an ink level that is sensed by the ink level sensing circuit.

Referring now to FIGS. 8–15, schematically illustrated therein is a specific implementation of an ink container 200 which includes an ink level sensing circuit in accordance with the invention, and which can be implemented as each of the ink containers 110–116 which are structurally substantially identical.

Figure 8:
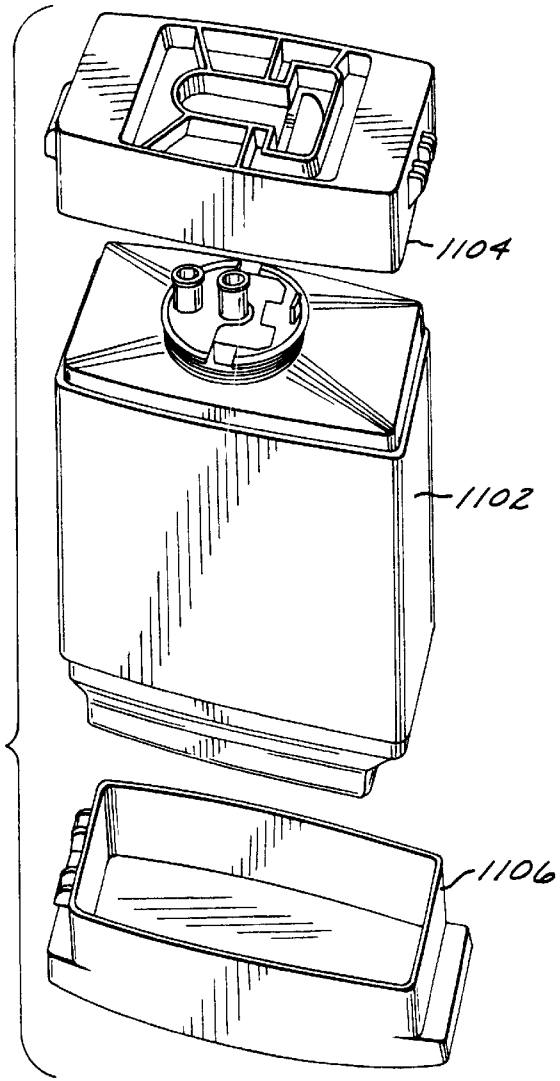
FIG. 8 is a schematic isometric exploded view illustrating the major components of an implementation of one of the ink containers of the printer/plotter system of FIG. 1 which employs an ink level sensing circuit in accordance with the invention.
Figure 9:
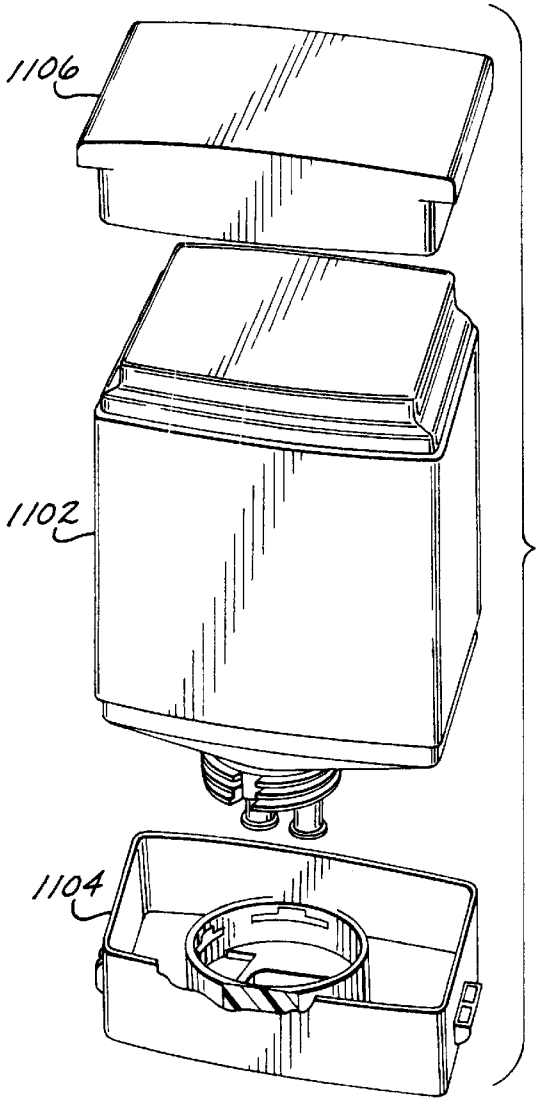
FIG. 9 is a further schematic isometric exploded view illustrating the major components of an implementation of one of the ink containers of the printer/plotter system of FIG. 1 which employs an ink level sensing circuit in accordance with the invention.

As shown in FIGS. 8–9, the ink container 200 generally includes a pressure vessel 1102, a chassis member 1120 attached to a neck region 1102A at a leading end of the pressure vessel 1102, a leading end cap 1104 attached to the leading end of the pressure vessel, and a trailing end cap 1106 attached to the trailing end of the pressure vessel 1102.

Figure 10:
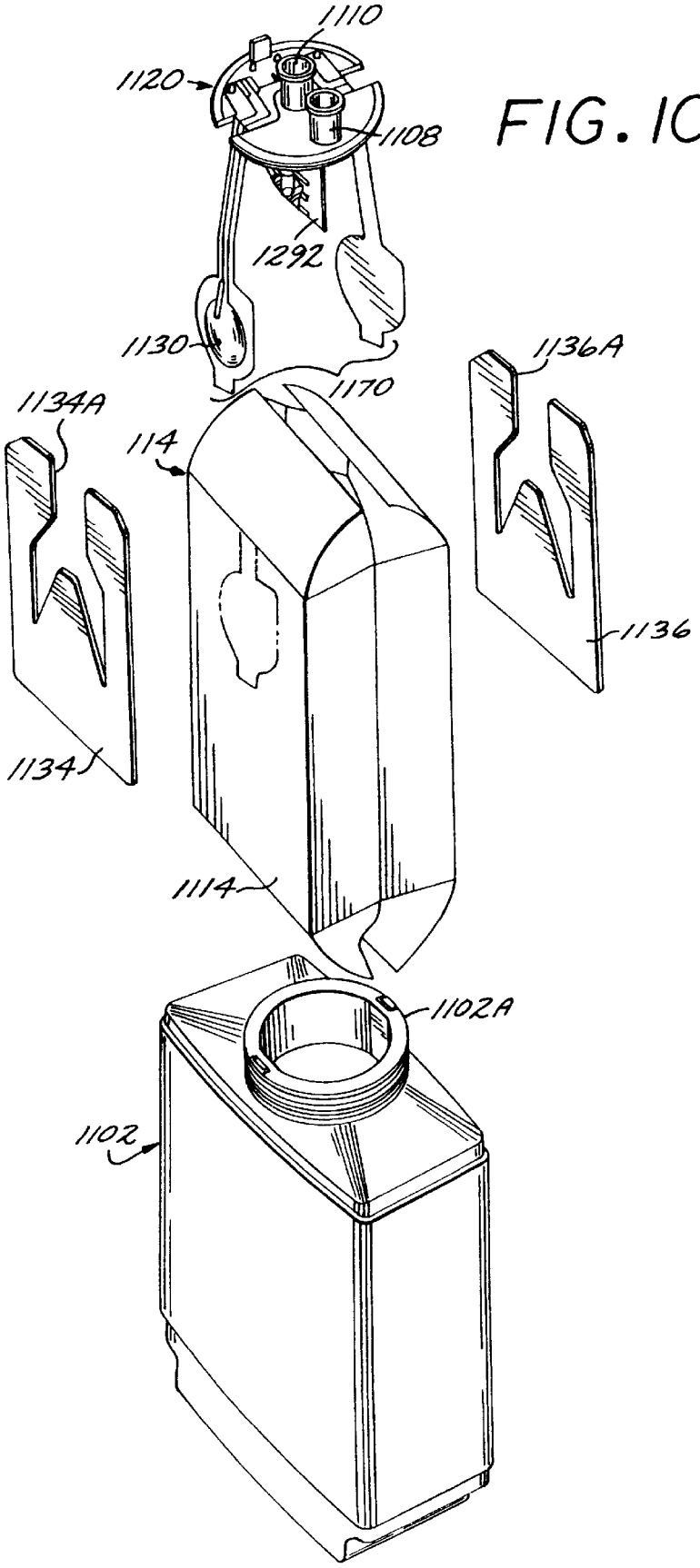
FIG. 10 is an exploded isometric view showing the pressure vessel, collapsible ink reservoir, ink level sensing circuitry, ink reservoir stiffening elements, and chassis member of the ink container of FIGS. 8 and 9.
Figure 11:
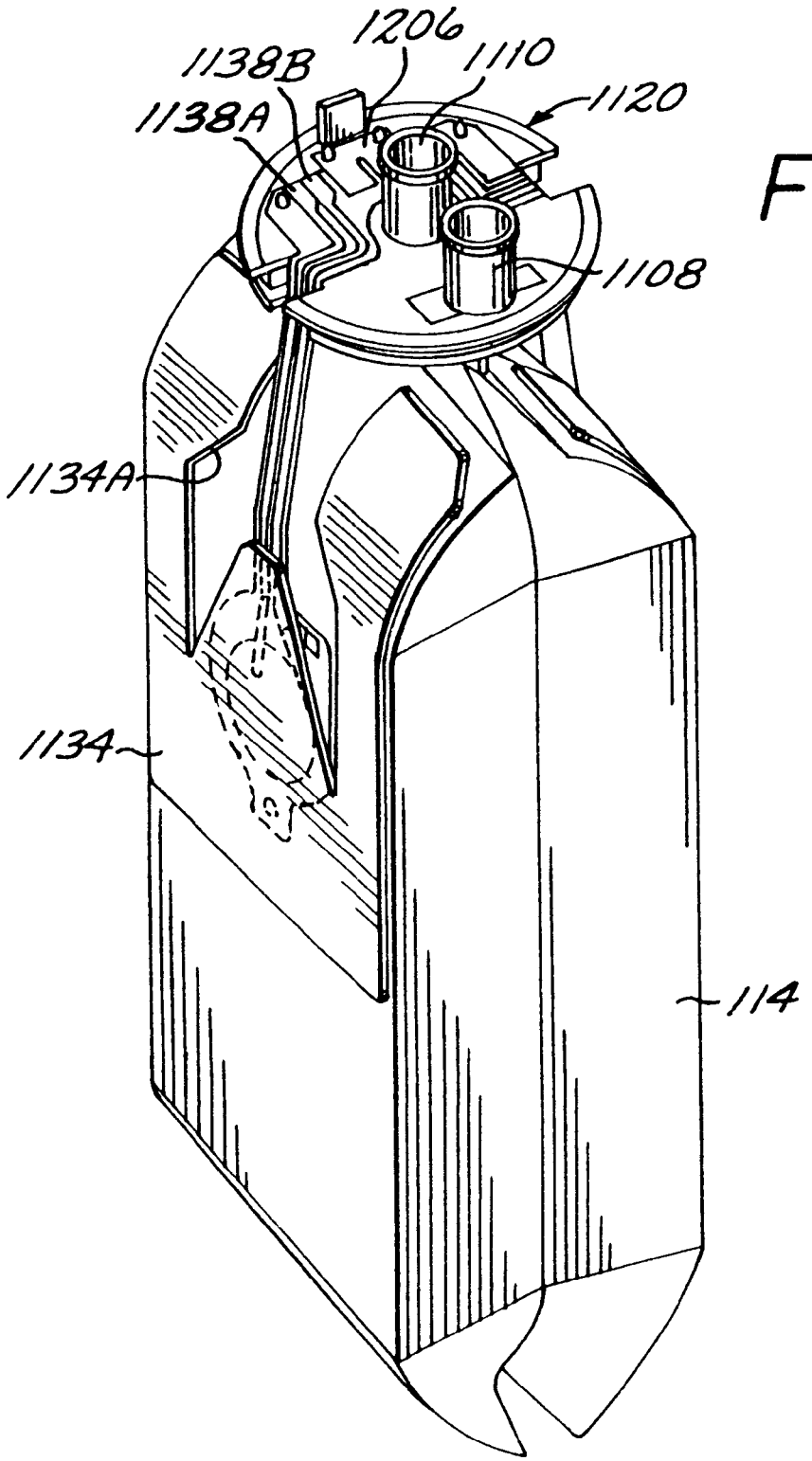
FIG. 11 is a schematic isometric view illustrating the collapsible ink reservoir, ink level sensing circuitry, ink reservoir stiffening elements, and chassis member of the ink container of FIGS. 8 and 9.
Figure 12:
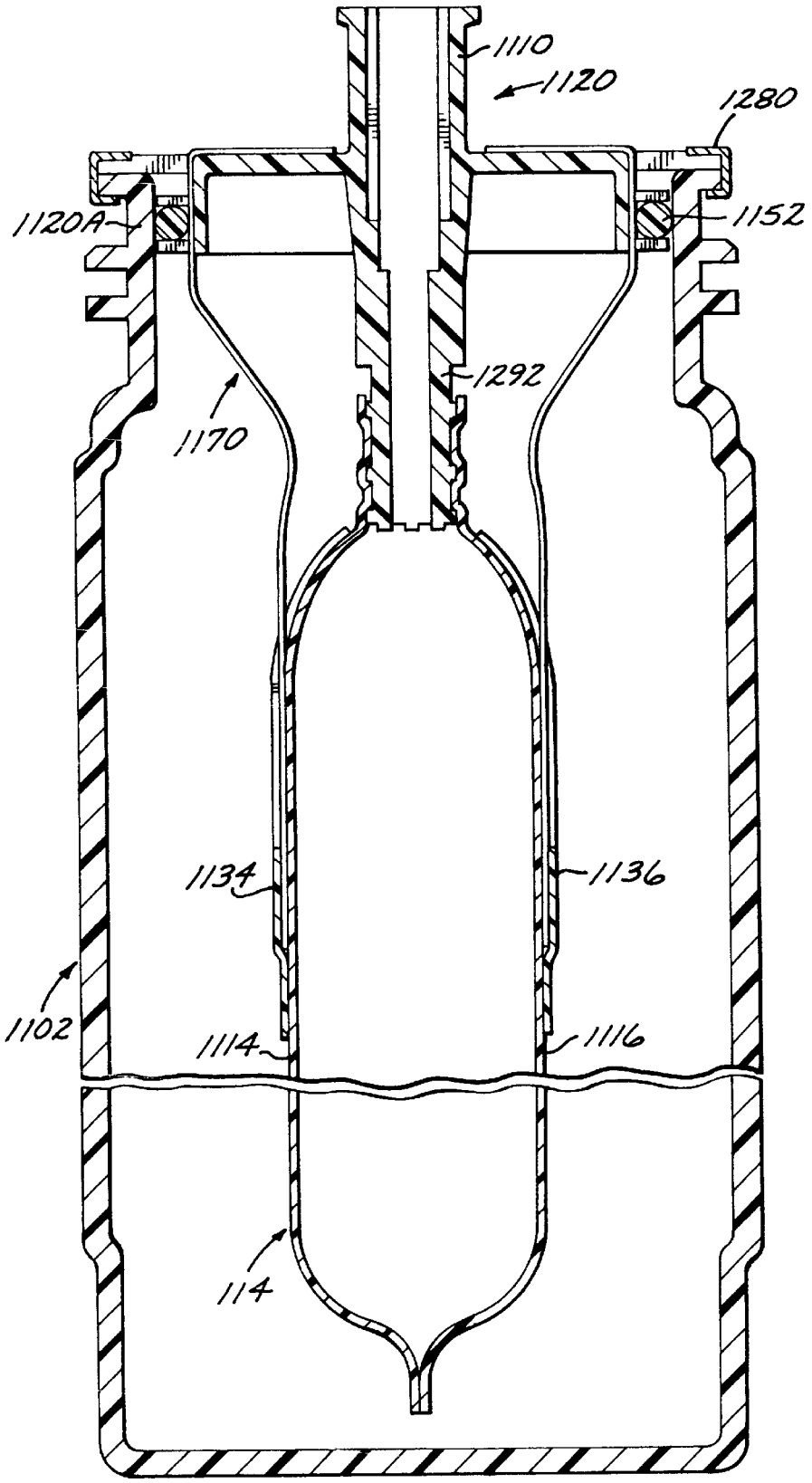
FIG. 12 is a cross-sectional view of the pressure vessel, collapsible ink reservoir, ink level sensing circuitry, ink reservoir stiffening elements, and chassis member of the ink container of FIGS. 8 and 9.

As more particularly shown in FIGS. 10–12, the ink container 200 further includes a collapsible ink bag or reservoir 114 disposed within the pressure vessel 1102, and an ink level sensing (ILS) circuit 1170 attached to the collapsible ink reservoir 114. The collapsible ink reservoir 114 is sealingly attached to a keel portion 1292 of the chassis 1120 which seals the interior of the pressure vessel 1102 from outside atmosphere while providing for an air inlet 1108 to the interior of the pressure vessel 1102, an ink outlet port 1110 for ink contained in the ink reservoir 114 and routing for conductive traces between the ink level sensing circuit 1170 and externally accessible contact pads disposed on the chassis member. The chassis 1120 is secured to the opening of the neck region 1102A of the pressure vessel 1102, for example by an annular crimp ring 1280 that engages a top flange of the pressure vessel and an abutting flange of the chassis member. A pressure sealing O-ring 1152 suitably captured in a circumferential groove on the chassis 1120 engages the inside surface of the neck region 1102A of the pressure vessel 1102.

The collapsible ink reservoir 114 more particularly comprises a pleated bag having opposing walls or sides 1114, 1116, and the ink level sensing circuit 1170 more particularly includes first and second substantially flat spiral inductive coils 1130, 1132 disposed on the opposing sides 1114, 1116.

In an exemplary construction, an elongated sheet of bag material is folded such that opposed lateral edges of the sheet overlap or are brought together, forming an elongated cylinder. The lateral edges are sealed together, and pleats are in the resulting structure generally in alignment with the seal of the lateral edges. The bottom or non-feed end of the bag is formed by heat sealing the pleated structure along a seam transverse to the seal of the lateral edges. The top or feed end of the ink reservoir is formed similarly while leaving an opening for the bag to be sealingly attached to the keel portion 1292 of the chassis 1120. By way of specific example, the ink reservoir bag is sealingly attached to keel portion 1292 by heat staking.

For reference purposes, the ink reservoir 114 has a longitudinal axis that extends from feed end to non-feed end, and is parallel to the axis of the ink outlet port 1110.

Stiffening elements 1134, 1136 are disposed on the opposing sides 1114, 1116 over the flat spiral inductive coils 1130, 1132 to enable a more predictable, consistent, and repeatable collapse of the ink reservoir 114 as the ink contained therein is depleted, to maintain the coils parallel to each other as the ink reservoir walls collapse toward each other while the remaining ink volume is in the range over which the ink level sensing circuit is active, and to reduce buckling of the ink reservoir in the region between the coils and the portion of the ink reservoir that is attached to the keel portion 1292. Maintaining the coils parallel to each other over a collapse range of interest with a more predictable, repeatable, and consistent collapse allows for more accurate sensing of ink remaining in the reservoir by adjacent the stiffening elements 1134, 1136. Pressurization within the pressure vessel also provides for more predictable and consistent collapse of the ink reservoir, with or without the stiffening elements 1134, 1136.

Figure 14:
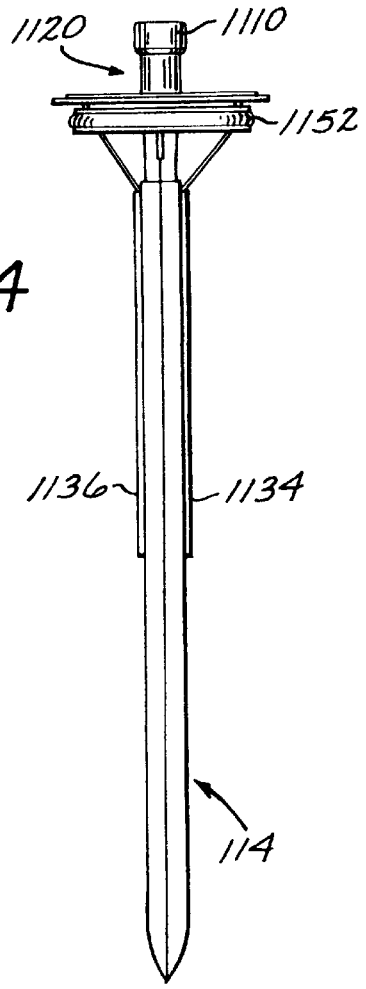
FIG. 14 an edge view of the collapsible ink reservoir, ink level sensing circuitry, ink reservoir stiffening elements, and chassis member of the ink container of FIGS. 8 and 9, with the collapsible ink reservoir in a flattened evacuated state.
Figure 13:
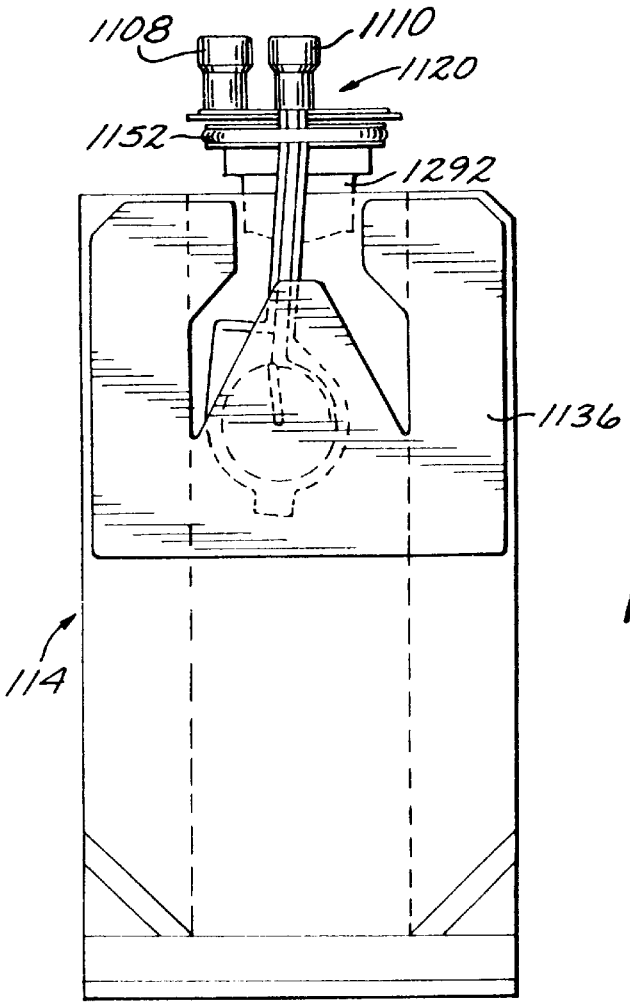
FIG. 13 is an elevational view of the collapsible ink reservoir, ink level sensing circuitry, ink reservoir stiffening elements, and chassis member of the ink container of FIGS. 8 and 9, with the collapsible ink reservoir in a flattened evacuated state.

The stiffeners generally extend over regions of the walls 1114, 1116 that can be flattened when the ink reservoir is empty and evacuated, as shown in FIGS. 13 and 14. Thus, for example, each of the stiffener 1134, 1136 extends laterally across the wall to which it is attached, and includes a cut-out 1134A, 1136A that provides clearance for folds, bumps or wrinkles in the walls 1114, 1116 caused by the keel portion 1292 and by the attachment of the ink reservoir to the keel portion 1292. Each stiffener further extends longitudinally from the feed end of the ink reservoir to a location slightly beyond the side of the coil that is away from the feed end of the ink reservoir. Limiting the extent of the stiffener from the feed end of the ink reservoir allows for the non-feed end of the ink reservoir to buckle as the ink reservoir collapses. In this manner, the stiffening elements reduce buckling of the walls 1114, 1116 between the coils and the feed end of the ink reservoir and allow buckling at the non-feed end of the ink reservoir.

For the particular implementation wherein the subassembly comprised of the ink reservoir, the ink level sensing circuit, and the stiffening elements need to be bent or curled into a C shaped configuration, as viewed along the longitudinal axis of the ink reservoir, for insertion into the pressure vessel, the stiffening elements 1134, 1136 are preferably flat resiliently deformable stiff sheets that return to a planar configuration in the absence of the biasing forces applied to bend the stiffening elements for insertion into the pressure vessel. In other words, the stiffening elements are stiff and yet sufficiently resilient so as to be not permanently deformed by the curling required for insertion into the pressure vessel. By way of illustrative example, the stiffening elements comprise relatively thin (e.g., 0.0005 inches) polyethylene terephthalate (PET) sheets.

The stiffening elements effectively cooperate with the walls of the ink reservoir to form wall regions of increased stiffness whose collapse with ink depletion is consistent and repeatable, and it should be appreciated that regions of the opposite walls 1114, 1116 of the ink reservoir can be formed as regions of increased stiffness in which case the stiffening elements 1134, 1136 can be omitted.

Each of the spiral coils 1130, 1132 can comprise a continuously curved winding having a perimeter that is generally defined by a conical section such as a circle or ellipse, for example, or each spiral coil can comprise a segmented winding comprised of serially connected segments having a perimeter that is generally defined by a polygon as a rectangle. The spiral coils 1130, 1132 are preferably positioned such that the line formed by their geometrical centers is orthogonal to the planes of the coils when the planes of the coils are parallel and when the ink reservoir is flat and without ink. In other words, the spiral coils 1130, 1132 are positioned such that their geometrical centers are substantially mirror images of each other on the walls 1114, 1116. In use, the container 200 is preferably rotationally positioned about its longitudinal axis, which extends between the open end thereof and the opposite closed end, such that the planes of the coils are vertical.

The areas of the stiffening elements 1134, 1136 (or rigid regions) are preferably greater than the areas of the respectively adjacent coils 1130, 1132. Also, the areas of the coils 1130, 1132 are respectively contained within the areas of the respectively adjacent stiffening elements 1134, 1136 (or rigid regions).

While the disclosed ink container 200 preferably includes pressurization, the ink level sensing circuit 1170 can be used without pressurization.

Figure 15:
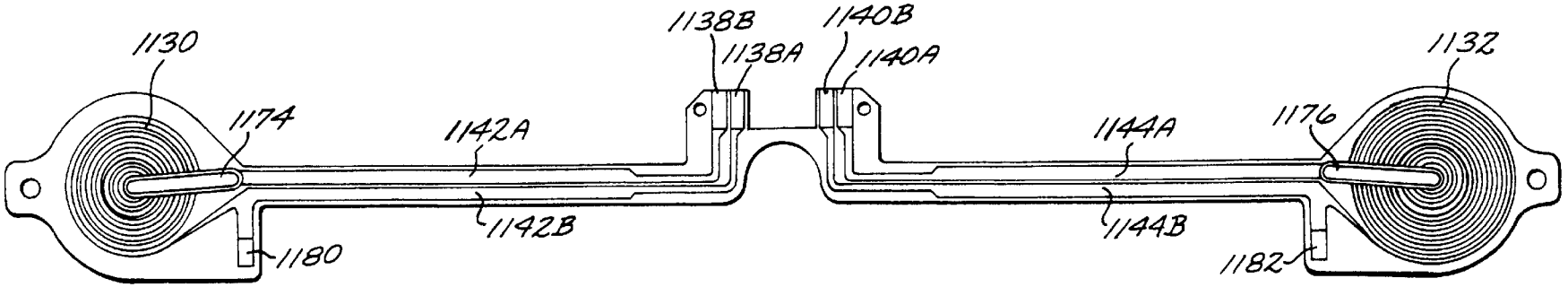
FIG. 15 is a schematic plan view of an implementation of the ink level sensing circuit of the invention as employed in the ink container of FIGS. 8 and 9.

As schematically illustrated in FIG. 15, the ink level sensing circuit 1170 is implemented, for example, as a flexible circuit wherein the flat coils 1130, 1132 and associated conductive elements by which the flat coils can be electrically accessed are disposed in laminar fashion between first and second flat unitary flexible substrates. In particular, the ink level sensing circuit further includes conductive leads 1142A, 1142B which extend between the flat coil 1130 and externally accessible contact pads 1138A, 1138B; and conductive leads 1144A, 1144B which extend between the flat coil 1132 and externally accessible contact pads 1140A, 1140B. The foregoing contact pads are exposed by respective openings in the appropriate flexible substrate of the flexible circuit, and are externally accessible in the sense that they can be conductively engaged by contact elements external to the ink container 200.

The externally accessible contact pads of the ink level sensing circuit are suitably disposed on the outside of the chassis 1120, and the conductive leads extend generally longitudinally within the pressure vessel 1102 from the chassis 1120 to the coils 1130, 1132. Portions of the conductive leads and associated portions of the flexible substrates of the ink level sensing circuit 1170 pass on the outside surface of the chassis between the O-ring 1152 and such outside surface. A suitably insulated jumper 1174 is connected between the conductive lead 1142A and the center of the flat coil 1130, while a suitable insulated jumper 1176 is connected between the conductive lead 1144A and the center of the flat coil 1132.

The ink level sensing circuit further includes ink leakage detectors comprised of conductive ink leakage detection pads 1180, 1182 respectively located adjacent the coils 1130, 1132 and respectively connected to conductive leads 1142B, 1144B. The ink leakage pads 1180, 1182 are exposed by openings in the outward facing flexible substrate of the ink sensing flexible circuit and are not covered by the stiffening elements 1134, 1136 so as to be contactable with any ink that accumulates in the pressure vessel 1102 as a result of ink leakage. Ink leakage, indicative of a broken ink reservoir, is detected for example by applying a voltage between the contact pad 1138B and a reference potential, and sensing the voltage between the contact pad 1140B and the reference potential. If the ink leakage contacts 1180, 1182 are immersed in ink, then the contact pad 1140B would be at a non-zero voltage; otherwise, the contact pad 1140B would be at zero volts. The ink leakage contact pads 1180, 1182 are preferably rotationally positioned relative to the coils 1130, 1132 so as to be elevationally low when the ink container is in its intended installed position.

By way of illustrative example, the coil portions and the contact portions of the flexible circuit comprising the ink level sensing circuit 1170 are attached to the walls 1114, 1116 and the chassis 1120 with pressure sensitive adhesive.

A memory chip package 1206 is also supported on the chassis 1120, for example between pairs of externally accessible ink level sensing circuit contact pads 1138A, 1138B and 1140A, 1140B. By way of illustrative example, the memory chip package includes memory access contacts which are connected to the print controller 82 when the ink container 200 is installed in the printing system 50, as are the externally accessible ink level sensing circuit contact pads 1138A, 1138B, 1140A, 1140B.

Further details as to a particular implementation of the ink container of FIGS. 8–15 are disclosed in commonly assigned co-pending U.S. Ser. No. 08/868,773, docket number 10970429, filed herewith, entitled "Ink Container Providing Pressurized Ink With Ink Level Sensor", incorporated herein by reference.

In use, the coils 1130, 1132 function as a non-contactive inductive transducer that indirectly senses the amount of ink in the ink reservoir by sensing the separation between the opposing walls 1114, 1116 which collapse toward each other as the ink supply is depleted. An AC excitation signal is passed through one coil (considered the input coil), inducing a voltage in the other coil (considered the output coil) whose magnitude increases as the separation decreases. The change in voltage in the output coil results from the change in the mutual inductance of the coils with change in the separation between the coils. The output voltage provided by the output coil is readily related to a corresponding ink volume, e.g., by values stored in the ink container memory.

A particular technique for energizing the input coil and sensing the output of the output coil is disclosed in previously identified U.S. Ser. No. 08/633,613, filed Apr. 17, 1996, docket number 10951138, entitled "Inductive Ink Level Detection Mechanism For Ink Supplies", incorporated herein by reference.

Preferably, the coils 1130, 1132 are positioned in areas of the ink reservoir that are subject to predictable, consistent and repeatable collapse. Further, the coils 1130, 1132 are positioned such that the ink level sensing circuit 1170 is active over a desired range of ink volume. For example, if it is desired that the ink level sensing circuit be active over an ink volume range that is within the lower half of the available ink volume, and wherein the feed end of the chassis or feed end of the container is elevationally lower than the opposite end when the container is in its installed position, the spiral coils 1130, 1132 are positioned closer to the ink outlet 1110, for example between the feed end of the reservoir which is attached to the chassis 1120 and the middle between the feed end of the ink reservoir and the opposite end. By way of illustrative example, the ink container 200 can be installed with the longitudinal axis of the container being tilted relative to horizontal by an angle in the range of about 5 to 30 degrees such that the chassis is elevationally lower that the opposite of the ink container, and with the ink container rotationally positioned about the longitudinal axis so that the planes of the ink level sensing coils are vertical.

Also, the coils can be positioned slightly off the lateral middle (wherein the lateral direction is orthogonal to the longitudinal direction) for installations wherein longitudinal axis of the ink reservoir is more horizontal than vertical. For example, for an installation wherein the longitudinal axis of the ink reservoir is about 15 degrees relative to horizontal with the feed end of the reservoir being lower than the non-feed end, the ink level sensing coils can be displaced toward what would be the elevationally higher edge of the walls 1114, 1116 by about 4 degrees, for example, whereby the coils are tilted up in the installed position relative to the longitudinal axis of the ink reservoir.

By way of further illustrative example, without limitation as to the relative number of turns contained in the coils, the coil area of the coil 1132, as the output coil, is larger than the coil area of the coil 1130, as the input coil, in at least one direction and not smaller than the coil area of the coil 1130 in any direction, such that if the output coil area and the input coil area were superimposed, the output coil area would completely overlap the input coil area and extend beyond the input coil area in at least one direction, wherein the coil area of a coil is the area occupied by the turns of the coil and the gap between adjacent turns. A coil area can be also considered as the area enclosed by the periphery of a coil. In other words, the input coil area can be completely contained within the output coil area, if such areas were placed on top of each other. For example, the output coil area and input coil can be similarly shaped (i.e., of the same shape), and the output coil area would have a bigger shape. For the particular example of generally circular coils, the coil area of the output coil has a radius that is greater than the radius of the coil area of the input coil. As another particular example, for generally rectangular coils, the output coil area would have a width that is greater than the width of the input coil, and a length that is greater than or equal to the length of the input coil. Broadly, the input coil area is completely containable within the output coil area which greater than the input coil area in at least one dimension or direction.

As a further example, the coil 1132, as the output coil, includes a greater number of turns than the coil 1130, as the input coil, without limitation as to the relative areas of the coils.

A larger output coil area that completely contains the input coil area and extends beyond the output coil area in at least one direction increases the tolerance in the alignment between the coils 1130, 1132 in at least one direction, which allows for easier manufacture. A larger number of turns in the output coil increases the level of the voltage of the coil output, which increases the accuracy of ink volume sensing.

The foregoing has thus been a disclosure of a printing system wherein ink remaining in an ink container is advantageously estimated pursuant to ink drop usage information provided by an ink container memory and ink level sense information provided by an ink level sensing circuit.

Although the foregoing has been a description and illustration of specific embodiments of the invention, various modifications and changes thereto can be made by persons skilled in the art without departing from the scope and spirit of the invention as defined by the following claims.

What is claimed is:

1. An ink container for an ink jet printing system having an ink jet printhead that selectively deposits ink drops on print media, the ink container comprising:

an ink reservoir for storing ink to be provided to the ink jet printhead;

an information storage device for storing information that is utilized by a controller for providing an estimate of available ink in said ink reservoir over a first estimated ink volume range; and an ink level sensing circuit for providing an ink level sense signal that is utilized by the controller for providing an estimate of available ink over a second estimated ink volume range that is different from said first estimated ink volume range.

2. The ink container of claim 1 wherein:

said ink reservoir comprises a collapsible reservoir; and said ink level sensing circuit is disposed on said collapsible reservoir.

3. The ink container of claim 2 wherein said ink level sensing circuit comprises an ink level sensing transducer for sensing a degree of collapse of said collapsible reservoir.

4. The ink container of claim 3 wherein said ink level sensing transducer comprises an inductive coil.

5. The ink container of claim 1 wherein said storage device stored information is indicative of an initial ink capacity of said ink reservoir.

6. The ink container of claim 1 wherein said storage device information is indicative of an estimated volume of ink remaining in said ink reservoir.

7. The ink container of claim 6 wherein said storage device information indicative of an estimated volume of remaining ink is periodically updated.

8. The ink container of claim 1 wherein said ink level sensing circuit is active over a sensing range of actual ink level contained in said ink reservoir, wherein said sensing range is intermediate a maximum actual ink level and a minimum actual ink level.

9. The ink container of claim 1 wherein said ink reservoir is replaceable separately from the printhead.

10. A printing system comprising:

an ink jet printhead for selectively depositing ink drops on print media;

an ink reservoir for storing ink to be provided to the ink jet printhead;

an information storage device for storing information that is indicative of an available volume of ink in the ink reservoir based on printing activity;

an ink level sensing circuit for providing an ink level sense output that is indicative of a sensed volume of ink in the ink reservoir; and a processor responsive to said storage device output and said ink level sense output for providing over a first estimated ink volume range a remaining ink level estimate that is based on said stored information, and for providing over a second estimated ink volume range that is different from said first estimated ink volume range a remaining ink level estimate that is based on said ink level sense output.

11. The printing system of claim 10 wherein:

said ink reservoir comprises a collapsible reservoir; and said ink level sensing circuit is disposed on said collapsible reservoir.

12. The printing system of claim 11 wherein said ink level sensing circuit comprises an ink level sensing transducer for sensing a degree of collapse of said collapsible reservoir.

13. The printing system of claim 12 wherein said ink level sensing transducer comprises an inductive coil.

14. The printing system of claim 10 wherein said storage device stored information is indicative of an initial ink capacity of said ink reservoir.

15. The printing system of claim 10 wherein said storage device information is indicative of an estimated volume of ink remaining in said ink reservoir.

16. The printing system of claim 15 wherein processor periodically updates said storage device information indicative of an estimated volume of remaining ink.

17. The printing system of claim 10 wherein said ink level sensing circuit is active over a sensing range of actual ink level contained in said ink reservoir, wherein said sensing range is intermediate a maximum actual ink level and a minimum actual ink level.

18. The printing system of claim 10 wherein said ink reservoir is replaceable separately from said printhead.

19. A method for determining an amount of ink remaining in an ink container installed in a printing system having an ink jet printhead for receiving ink from the ink container and selectively depositing ink drops on print media, the method comprising the steps of:

providing a calculated remaining ink volume based on ink drop count information and a printhead drop volume estimate;

providing a sensed remaining ink volume based on sensed ink volume information; and providing (1) over a first estimated ink volume range an ink volume estimate based on the calculated remaining ink volume and (2) over a second estimated ink volume range that is different from the first estimated ink volume range an ink volume estimate based on the sensed remaining ink volume.

20. The method of claim 19 wherein the step of providing an ink volume estimate includes the steps of:

providing an ink volume estimate that corresponds to the calculated remaining ink volume while the sensed remaining ink volume is greater than a predetermined threshold; and providing an ink volume estimate that corresponds to the sensed remaining ink volume while the sensed remaining ink volume is less than the predetermined threshold.

21. The method of claim 20 wherein the step of providing an ink volume estimate further includes the steps of:

determining a revised printhead drop volume estimate based on drop count information and a sensed remaining ink volume that is less than the predetermined threshold and greater than another predetermined threshold;

providing an updated calculated remaining ink volume based on the ink drop count information and the revised printhead drop volume estimate; and providing an ink volume estimate that corresponds to the updated calculated remaining ink volume while the sensed remaining ink volume is less than the another predetermined threshold.

22. The method of claim 19 wherein the step of providing an ink volume estimate includes the steps of:

providing an ink volume estimate that corresponds to the calculated remaining ink volume while the sensed remaining ink volume is greater than a predetermined threshold;

determining a revised printhead drop volume estimate based on drop count information and a sensed remaining ink volume when the sensed remaining ink volume reaches the predetermined threshold;

providing an updated calculated remaining ink volume based on the ink drop count information and the revised printhead drop volume estimate; and providing an ink volume estimate that corresponds to the updated calculated remaining ink volume.

23. The method of claim 19 wherein the step of providing an ink volume estimate includes the steps of:

providing an ink volume estimate that corresponds to the sensed remaining ink volume while the sensed remaining ink volume is greater than a predetermined threshold; and providing an ink volume estimate that corresponds to the calculated remaining ink volume while the sensed remaining ink volume is less than the predetermined threshold.

24. The method of claim 23 wherein the printhead drop volume estimate is based on a sensed remaining ink volume and ink drop count information.

25. An ink container having an ink reservoir for providing ink to a printing system that includes a controller for controlling operation of the printing system, comprising:

a first ink level estimation portion for providing first information that is utilized by the controller for providing an estimate of available ink volume in the reservoir over a first estimated ink volume range; and a second ink level estimation portion for providing second information that is utilized by the controller for providing the estimate of available ink volume in the reservoir over a second estimated ink volume range that is different from said first estimated ink volume range.

26. The ink container of claim 25 wherein the estimate of available ink over the first estimated ink volume range is based solely on said first information.

27. The ink container of claim 25 wherein the estimate of available ink over the second estimated ink volume range is based solely on said second information.

28. The ink container of claim 25 wherein the estimate of available ink over the second estimated ink volume range is based on said first information and said second information.

29. The ink container of claim 25 wherein the estimate of available ink is based solely on said first information so long as said second information indicates that available ink volume is greater than a threshold level.

30. The ink container of claim 25 wherein the estimate of available ink is based solely on said second information after said second information indicates that available ink volume is less than a threshold level.

31. The ink container of claim 25 wherein the estimate is based on said first information and said second information after said second information indicates that available ink volume is less than a threshold level.

32. The ink container of claim 25 wherein said second ink level estimation portion includes apparatus for sensing whether ink volume in said reservoir is less than a threshold level.

33. The ink container of claim 32 wherein the estimate of available ink is based solely on said first information so long as said second ink level estimation portion senses that ink volume is greater than the threshold level.

34. The ink container of claim 32 wherein the estimate of available ink is based solely on said second information after said second ink level estimation portion senses that ink volume has decreased to less than the threshold level.

35. The ink container of claim 32 wherein the estimate is based on said first information and said second information after said second ink level estimation portion senses that ink volume has decreased to less than the threshold level.

36. An ink jet printing system comprising:

an ink jet printhead for selectively depositing ink drops on print media;

an ink reservoir for storing ink to be provided to the ink jet printhead;

a first ink level estimation portion for providing first information indicative of available ink volume in the reservoir;

a second ink level estimation portion for providing second information indicative of available ink volume; and a processor responsive to said first information and said second information for providing an estimate of available ink volume in the reservoir, wherein the estimate is based on said first information while one of said first information and said second information indicates that ink level is greater than a threshold level.

37. The ink jet printing system of claim 36 wherein said the estimate of available ink is based solely on said first information so long as said second ink level estimation portion senses that ink volume is greater than the threshold level.

38. The ink jet printing system of claim 36 wherein the estimate of available ink is based solely on said second information after said second ink level estimation portion senses that ink volume has decreased to less than the threshold level.

39. The ink jet printing system of claim 36 wherein the estimate is based on said first information and said second information after said second ink level estimation portion senses that ink volume has decreased to less than the threshold level.

40. The ink jet printing system of claim 36 wherein said second level estimation portion includes apparatus for sensing ink level.

41. A method of providing an estimate of ink volume in an ink reservoir, comprising the steps of:

causing a first ink level estimation portion to provide first information indicative of available ink volume;

causing a second ink level estimation portion to provide second information indicative of available ink volume;

providing (1) over a first estimated ink volume range an ink volume estimate that is based on the first information and (2) over a second estimated ink volume range that is different from the first estimated ink volume range an ink volume estimate that is based on the second information.

42. The method of claim 41 wherein the step of providing an ink volume estimate includes the steps of:

providing an ink volume estimate that is based on the first information while the second information indicates that ink level is greater than a threshold; and providing an ink volume estimate that is based on the second information after the second indicates that the ink volume is less than the threshold.

43. The method of claim 41 wherein the step of providing an ink volume estimate includes the steps of:

providing an ink volume estimate that is based solely on the first information while the second information indicates that ink level is greater than a threshold; and providing an ink volume estimate that is based on the second information after the second information indicates that the ink volume is less than the threshold.

44. The method of claim 41 wherein the step of providing an ink volume estimate includes the steps of:

providing an ink volume estimate that is based on the first information while the second information indicates that ink level is greater than a threshold; and providing an ink volume estimate that is based solely on the second information after the second information indicates that the ink volume is less than the threshold.

45. The method of claim 41 wherein the step of providing an ink volume estimate includes the steps of:

providing an ink volume estimate that is based on the first information while the second information indicates that ink level is greater than a threshold; and providing an ink volume estimate that is based on the first information and the second information after the second information indicates that the ink volume is less than the threshold.

46. The method of claim 41 wherein the step of causing a second ink level estimation portion to provide second information includes the step of sensing ink level with an ink level sensor.

* * * * *